US006571953B2

(12) United States Patent
Sherline et al.

(10) Patent No.: US 6,571,953 B2
(45) Date of Patent: Jun. 3, 2003

(54) PRINTED-THERMOPLASTIC TAMPER-RESISTANT PACKAGE

(75) Inventors: Drew Sherline, Coto de Caza, CA (US); Mark G. Hacker, Collierville, TN (US)

(73) Assignee: One Source Industries, LLC, Irvine, CA (US)

( * ) Notice: Subject to any disclaimer, the term of this patent is extended or adjusted under 35 U.S.C. 154(b) by 0 days.

(21) Appl. No.: 09/848,071

(22) Filed: May 3, 2001

(65) Prior Publication Data

US 2002/0162764 A1 Nov. 7, 2002

(51) Int. Cl.[7] ..... B65D 75/36
(52) U.S. Cl. ..... 206/459.5; 206/461; 206/807
(58) Field of Search ..... 206/459.5, 461–471, 206/526, 457, 807; 53/373.8; 283/81

(56) References Cited

U.S. PATENT DOCUMENTS

| | | | | |
|---|---|---|---|---|
| 2,767,711 A | | 10/1956 | Ernst | |
| 3,067,039 A | | 12/1962 | Crane | |
| 3,498,018 A | | 3/1970 | Seiferth et al. | |
| 3,830,415 A | * | 8/1974 | Jacobson et al. | 224/230 |
| 3,979,016 A | | 9/1976 | Frater | |
| 4,082,877 A | | 4/1978 | Shadle | |
| 4,623,062 A | | 11/1986 | Chase et al. | |
| 4,669,610 A | * | 6/1987 | Lindsey et al. | 206/461 |
| 4,718,547 A | | 1/1988 | MacTavish | |
| 4,771,888 A | | 9/1988 | Lundeen | |
| 4,804,984 A | * | 2/1989 | Heuer et al. | 206/461 |
| 5,074,416 A | * | 12/1991 | Hustad | 206/471 |
| 5,143,218 A | | 9/1992 | Brauckmann | |
| 5,188,222 A | | 2/1993 | Pierce | |
| 5,259,169 A | * | 11/1993 | Appelbaum et al. | 53/373.8 |
| 5,388,695 A | * | 2/1995 | Gilbert | 206/457 |
| 5,802,890 A | | 9/1998 | Espada-Velasco | |
| 5,803,253 A | * | 9/1998 | Zakarian | 206/471 |
| 5,944,173 A | | 8/1999 | Boire et al. | |
| 5,979,662 A | | 11/1999 | Green | |
| 6,053,321 A | | 4/2000 | Kayser | |
| 2001/0032796 A1 | * | 10/2001 | Rubenstein | 206/461 |

FOREIGN PATENT DOCUMENTS

| | | |
|---|---|---|
| DE | 2 224 924 | 12/1973 |
| FR | 2 737 197 | 1/1997 |
| GB | 2 188 035 | 9/1987 |

* cited by examiner

*Primary Examiner*—Jim Foster
(74) *Attorney, Agent, or Firm*—Knobbe, Martens, Olson & Bear, LLP

(57) ABSTRACT

A low-cost tamper-resistant product package is provided. The package comprises a substantially flat thermoplastic sheet forming a package backing, and a molded plastic cover sealed to the backing. The backing and cover are preferably formed of a plastic, such as polyvinyl chloride or polyethylene, that is difficult to puncture, cut or tear. The seal between the backing and cover is preferably difficult to compromise, so that human hands have great difficulty separating the backing and cover. RF welding and ultrasonic welding are preferred methods of sealing the package. The plastic backing is adapted to be printed upon directly. The cover preferably includes a ridge around its perimeter to inhibit bending of the package and assist in package display. The cover also preferably includes at least one bulge, forming therein a hollow recess for housing a product.

8 Claims, 4 Drawing Sheets

PRINTED-THERMOPLASTIC TAMPER-RESISTANT PACKAGE

BACKGROUND OF THE INVENTION

1. Field of the Invention

The present invention relates to retail product packaging. More specifically, the present invention provides a retail product display package that is not only resistant to theft and tampering, but also inexpensive to manufacture.

2. Description of the Related Art

Theft is a problem that has long plagued retail establishments. High-margin goods, which are attractive to thieves because of their high price or high resale value, are of special concern to store owners who wish to avoid being driven out of business by shoplifters. Often, retail stores place these high-margin goods behind a glass counter for safekeeping. That way, store personnel do not have to occupy themselves with watching over customers to make sure they are not pilfering goods.

This solution is effective at preventing theft, but has the undesirable side effect of lowering sales. For a variety of reasons, many customers are uncomfortable asking a sales clerk to help them. Other customers are simply too impatient to wait for a busy clerk to get to them. No matter what the reason, if a customer cannot quickly and easily gain access to an item, he or she will not purchase it.

As an alternative to placing the goods in a protective case, many stores instead place high-margin items inside oversized packaging that will not fit within even the largest of pockets, and then place the packaging on shelves where customers can easily access the goods. The packaging is preferably tamper-resistant to prevent shoplifters from tearing, puncturing, cutting, or folding the packaging and concealing the item on their person before exiting the store.

Three basic types of oversized packaging are currently in use. The first, skin packs, consist of shrink wrap and cardboard. The product is placed within a cardboard frame, and then the unit is covered with shrink wrap to bind the product to the cardboard. The cardboard is usually covered with printing, such as product information or advertising, which is visible through the transparent shrink wrap. Product information printed directly on the packaging increases the chances that a customer will buy the product by informing him or her of its novel features and advantages over other similar products, while brightly colored advertising increases the product's visibility on the shelf.

Skin packs have long been a favorite of retailers because of their low cost. By keeping the cost of the packaging low, the price of the packaged item remains low, thus increasing sales. Shoplifters, however, easily tamper with skin packs. Their flimsy construction, with cardboard and shrink wrap, makes them susceptible to being easily torn open. Once the packaging is compromised, the item within is easily pocketed and stolen. As a result, skin packs are not suitable for packaging high-price items.

A second type of oversized packaging, blister packs, consist of thermoformed plastic shells with cardboard. An example of this type of package is shown in U.S. Design Patent No. D438,104. The cardboard backing may be printed on directly and then secured to the transparent plastic clamshell by gluing, stapling or other convenient means.

U.S. Pat. No. 6,053,321 to Kayser discloses a blister pack display card with reusable container. The reusable plastic container is mounted to the display card in a tamper-resistant manner. The reusable container has a tray and a lid with the tray having frangible flanges thereon which are sealed to a presentation side of the display card. The lid has a deep channel which is received frictionally into the tray for securely closing the reusable container. Both the lid and the tray have enlarged finger engageable pull tabs for ease of opening the reusable container. Since the tray is heat sealed to the presentation side of the display card, any attempt to remove the tray from the display card will be evident, as the surface of the display card will be damaged.

Like skin packs, blister packs are also not strong enough theft deterrents to be suitable for packaging high-margin goods. A thief may discreetly tear the flimsy cardboard backing, enabling him or her to remove the product inside.

Another type of packaging that is more resistant to tampering than the blister pack is the clamshell. Clamshells consist of two molded pieces of transparent plastic, PVC, or other material that is difficult for human hands to tear. The pieces are sometimes mirror images of one another, with the edges of one half designed to mate or fit within the edges of the other.

To assemble the clamshell package the product is placed between the two halves, which are then brought together. The product placement and closing steps are difficult to automate, and so these steps are usually performed by a human. Once the package is closed, the edges are secured to each other with glue, heat or other means suitable to prevent the edges from being easily separated. Because the plastic is generally not suitable for accepting print, a colorful cardboard insert is usually placed between the two plastic halves in order to provide advertising or product information. This insert also must be positioned by human hands.

An example of a clamshell is shown in U.S. Pat. No. 4,623,062 to Chase et al., which discloses an anti-theft container for a compact digital audio disc. The container includes a fold-over album having an outer flat sheet of die cut, thin, soft PVC material, and an inner shell of thin, rigid, vacuum-formed PVC material. The inner shell has first and second square portions, each having a rib formed therein for engagement with one another when the album is folded over. A middle insert of advertising literature is sealed between the inner shell and the outer sheet. A fold-over protector member encloses the inner and outer shells. The protector member has a vacuum-formed, clear, rigid PVC shell, a rib, an extending flap, and a hinge therebetween for folding the protector member. The front of the protector member temporarily engages the first portion of the inner shell via the complementary ribs, whereas the flap of the protector member folds over the outer sheet of the album. The side edges of the protector member extend beyond the side edges of the inner shell and the outer sheet to provide an area for sealing the shell of the protector member to the flap of the protector member, without being sealed directly to the album. The protector member, when sealed, prevents the album from being folded and shoplifted.

A slightly different type of clamshell is disclosed in U.S. Pat. No. 5,143,218 to Brauckmann, which discloses a self-service package for containing small parts. The package includes a bottom part having a perimeter wall, thereby forming a cup shape. A lid, also having a perimeter wall that forms a cup shape, overlaps the perimeter wall of the bottom part to close the container. An adhesive label spans the boundary between the two halves to seal them together.

U.S. Pat. No. 4,771,888 to Lundeen discloses a standard audio cassette display and storage holder. The holder consists of a rigid back panel with a cassette holding area and a separate larger graphics area. The panel has a flange that carries cassette identification information and it also seals the open part of the cassette. The rigid back panel and cassette can be over-packaged for marketing with thin film shrink wrap.

Clamshells such as those just described are effective at deterring theft because they are difficult to fold, nearly impossible to tear open, and difficult to cut open without attracting attention. They are, however, quite expensive to manufacture. First, the plastic used to make them is usually quite thick, so material costs are high. Second, since the steps of placing the product and insert inside the packaging and closing the packaging are difficult to automate, labor costs are high. The high cost of the clamshell packaging raises the overall price that consumers must pay for products housed in such packaging. The higher the price, the lower the sales volume.

Two other types of packaging that are not necessarily designed to prevent theft, but that include two plastic members sealed to one another, are currently available. The first, a packaging for a COLGATE® toothbrush, comprises an open box made of rigid plastic and having a flexible plastic cover adhered to a rim of the box. The plastic cover includes printing. A tab on the corner of the cover enables a consumer to easily tear off the cover in order to access the product inside. The second packaging, a container for a roll of postage stamps, comprises a rigid plastic shell shaped either as a hollow cylinder with one open end, or as a U. The open end of the shell is covered with a flexible plastic seal that contains printing. The seal is easily peeled from the shell to access the stamps.

Therefore, an oversized product package that is difficult to deform or quietly tear open, is capable of displaying informative product information, and can be cheaply manufactured, would be of great benefit to the retail sales industry.

SUMMARY OF THE INVENTION

The printed-thermoplastic tamper-resistant package of this invention has several features, no single one of which is solely responsible for its desirable attributes. Without limiting the scope of this invention as expressed by the claims that follow, its more prominent features will now be discussed briefly. After considering this discussion, and particularly after reading the section entitled "Detailed Description of the Drawings," one will understand how the features of this invention provide advantages, which include excellent resistance to tearing and folding, low cost of manufacture and ability to display informative product information.

The invention includes a flat sheet of thermoplastic, preferably PVC, PET, or other material that is resistant to puncture and tearing. Product information or advertising is printed directly upon one or both sides of the plastic. The plastic sheet is preferably permanently adhered to, and forms a backing for, a transparent molded-plastic cover.

BRIEF DESCRIPTION OF THE DRAWINGS

The preferred embodiments of this invention, illustrating its features, will now be discussed in detail. These embodiments depict the novel and non-obvious printed-thermoplastic tamper-resistant package of this invention shown in the accompanying drawings, which are for illustrative purposes only. These drawings include the following figures, in which like numerals indicate like parts.

DETAILED DESCRIPTION OF THE PREFERRED EMBODIMENTS

Figure 1:
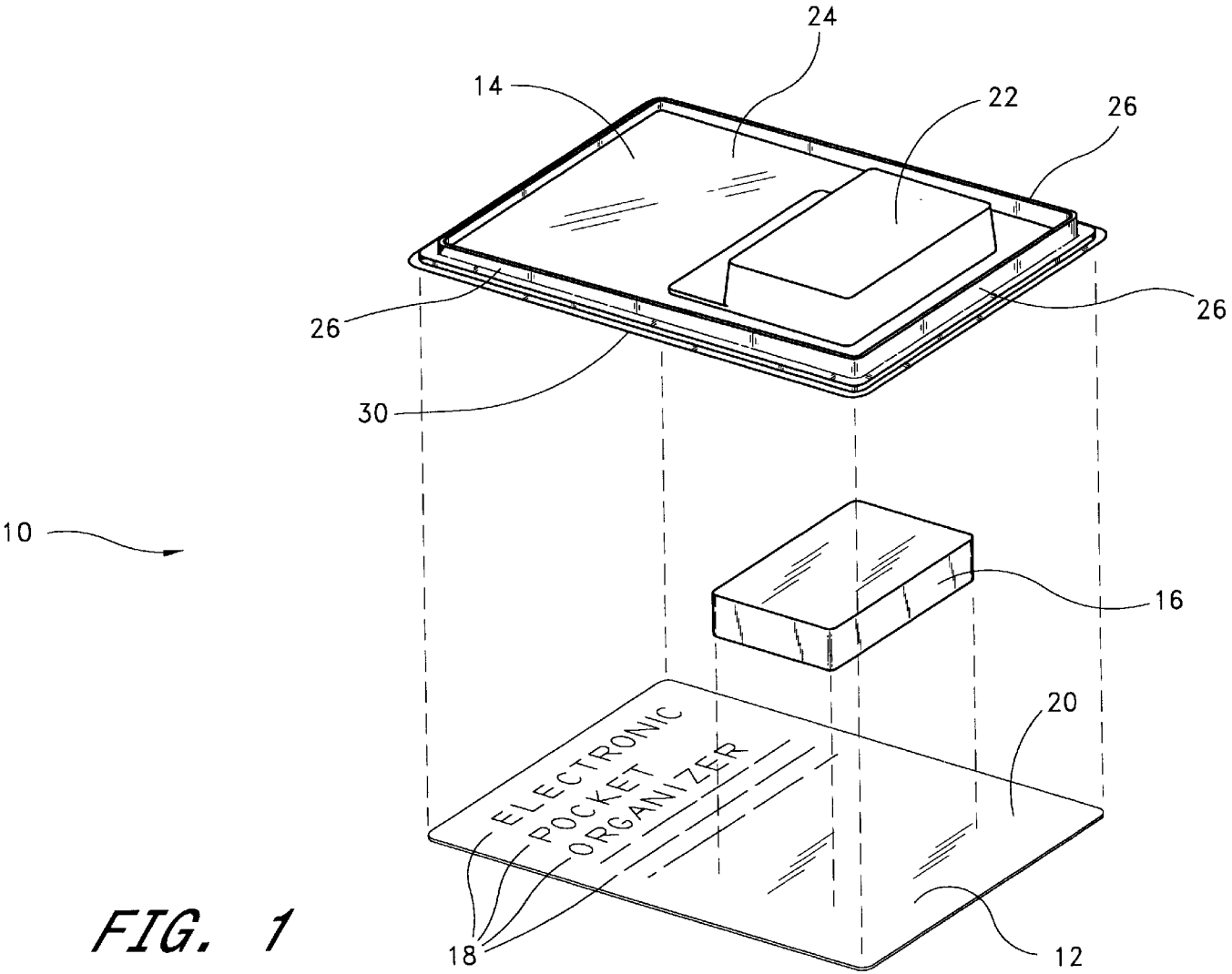
FIG. 1 is an exploded perspective view of the printed-thermoplastic tamper-resistant package according to the present invention.

The printed-thermoplastic tamper-resistant package 10 shown in FIG. 1 comprises a substantially flat, thin backing 12, and a molded front cover 14. Although not a part of the invention, a product 16 is shown between the backing 12 and cover 14 for illustrative purposes. The backing 12 is preferably constructed of a thermoplastic that is resistant to tearing. In addition, the backing 12 may be difficult to puncture or rip. Preferred materials for the backing 12 are polyvinyl chloride (PVC), polyethylene (PET), and other materials having similar properties.

Figure 2:
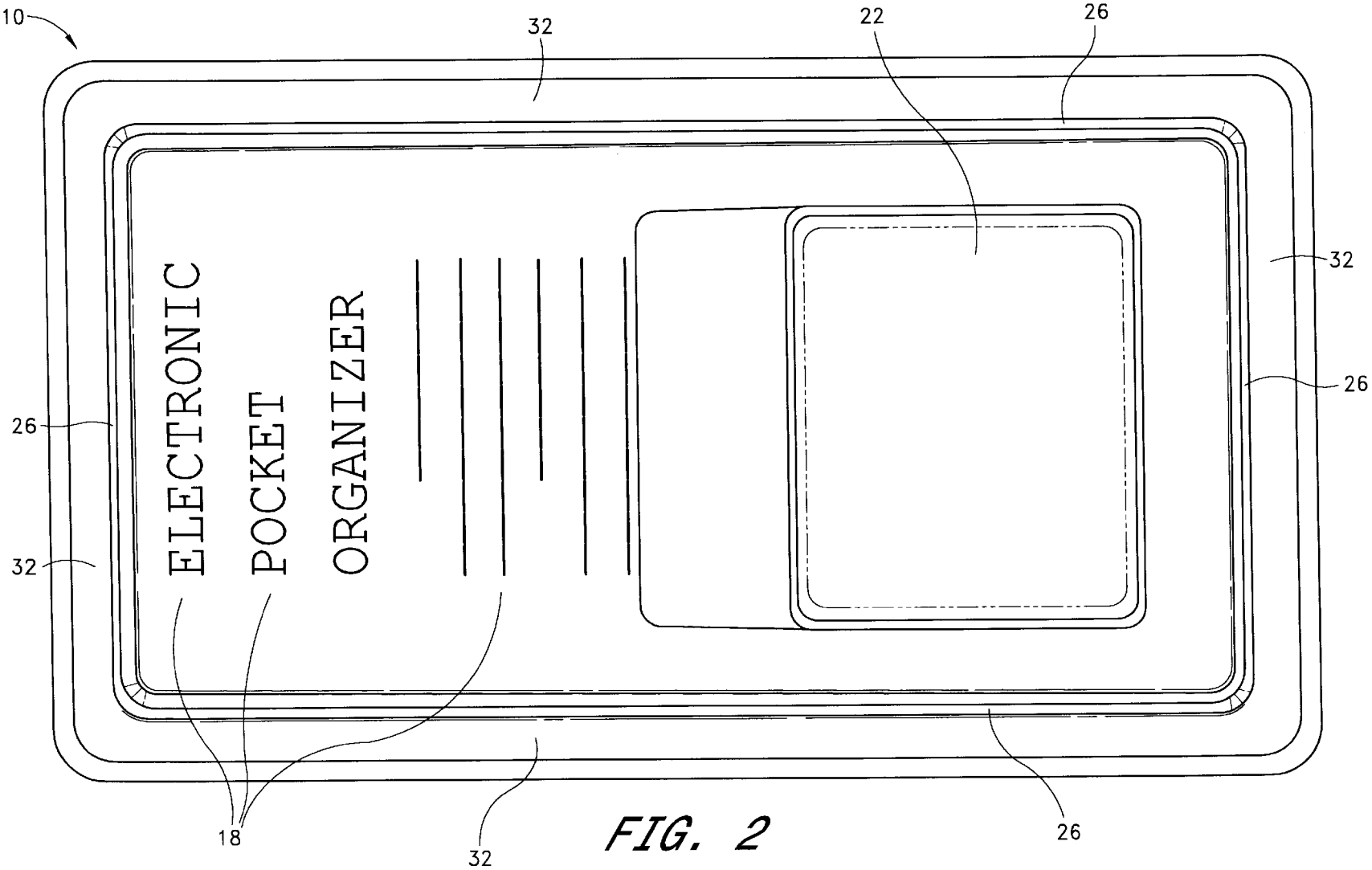
FIG. 2 is a front elevational view of the package of FIG. 1.

The plastic backing 12 is also preferably adapted, as PVC and PET are, to receive print 18. In FIGS. 1 and 2, the front surface 20 of the backing 12 includes print 18. This print 18 is preferably colorful, so that the package 10 is very visible on store shelves. The print 18 also preferably includes pertinent information about the product 16, such as features for which a consumer might be searching. In a preferred embodiment, the back surface (not shown) of the backing 12 also includes informative print. Alternatively, the backing 12 may be printed on only one side or in black or white depending on the color of the backing 12.

The ability of the backing 12 to receive print 18 eliminates the need to place a cardboard insert within the package 10, as with some prior art packages. The elimination of the cardboard insert lowers both the cost of producing the package 10 itself, and the cost of assembling the product 16 and package 10 together. The cost of producing the package 10 is lowered because fewer materials are needed. The cost of assembling the product 16 and package 10 together is reduced because the labor step of placing the cardboard insert within the package 10 is eliminated. The current package 10 is thus advantageously cheaper to produce and assemble than many other prior packages.

Like the backing 12, the front cover 14 is also preferably constructed of a thermoplastic that is resistant to tearing, puncturing and cutting. Preferred materials for the cover 14 are polyvinyl chloride (PVC), polyethylene (PET), and other materials having similar properties. Unlike the backing 12, however, the cover 14 is preferably transparent, so that a customer can easily view the contents of the package 10 and the print 18 on the front surface 20 of the backing 12.

Figure 3:
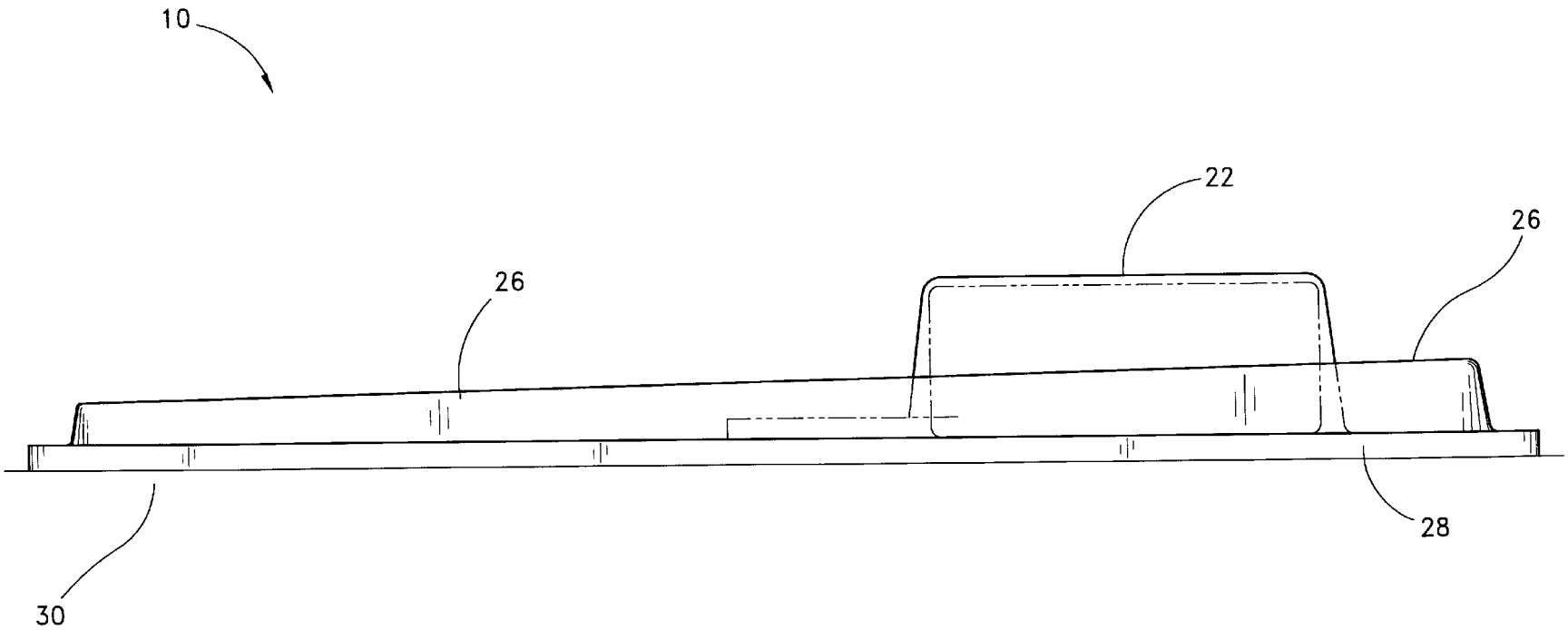
FIG. 3 is a left-side elevational view of the package of FIG. 1.
Figure 4:
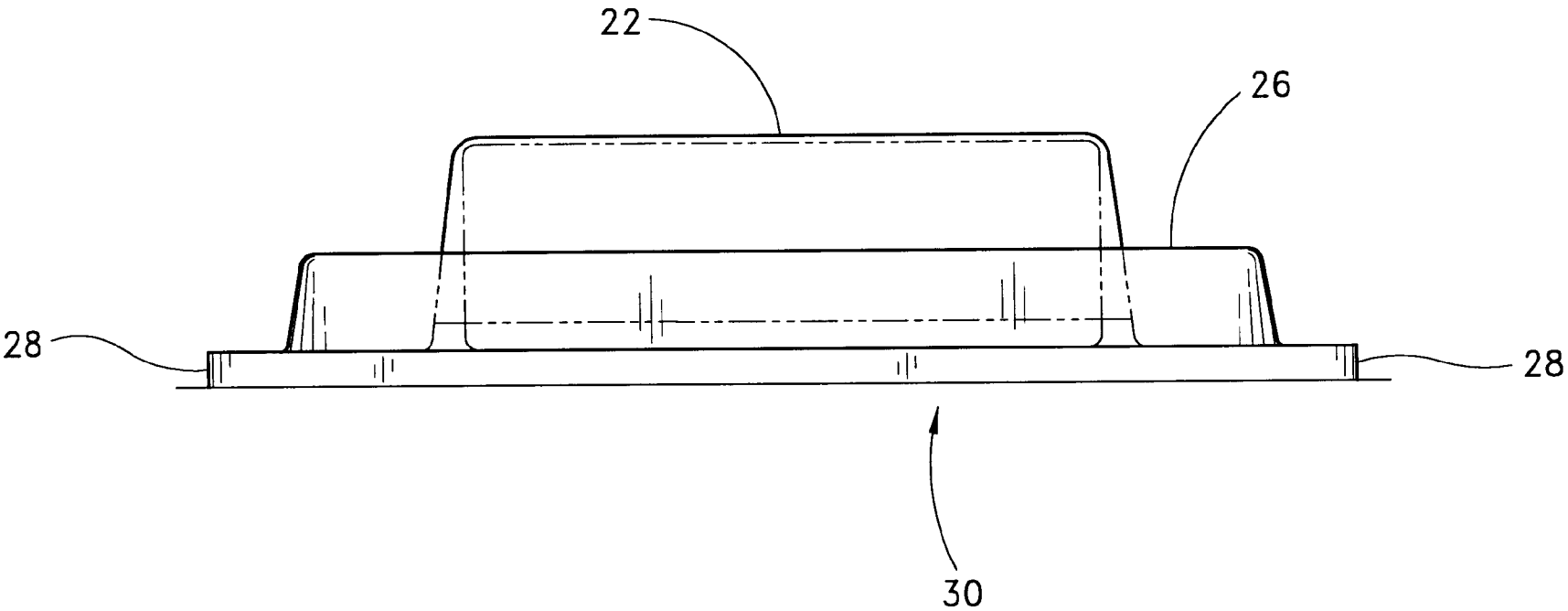
FIG. 4 is a bottom plan view of the package of FIG. 1.

The cover 14, which is best seen in FIGS. 2–4, is molded as a substantially flat sheet including at least one hollow bulge 22 protruding outwardly from the front surface 24 of the cover 14. Preferably the cover 14 is vacuum formed. The bulge 22 forms a hollow interior space in which to house the product 16 within the assembled package 10. Therefore, the bulge 22 may be virtually any size and shape as appropriate to fit the product 16.

The cover 14 preferably includes a raised ridge 26 that projects outwardly from the front surface 24 of the cover and substantially encircles the outside edge of the cover 14. The ridge 26 provides the cover 14 with greater rigidity, thereby increasing the package's 10 resistance to bending. The ridge 26 thus prevents a thief from easily folding the package 10 in half in order to more easily conceal it under his or her clothing or inside a purse or shopping bag. In addition, the raised ridge 26 assists in the vertical display of multiple packages 10 in a box (not shown). Rather than including a ridge 26, the cover 14 may instead be constructed of plastic that is thick enough to resist bending and, therefore, the ridge 26 would not be required and may easily be eliminated.

The cover 14 also preferably includes a raised lip 28 about the perimeter of its back surface 30 (FIGS. 3 and 4). The path traced by the lip 28 about the perimeter of the cover 14 is preferably the same shape as, but of slightly larger dimension than, the edges of the backing 12. The lip 28, together with a rim 32 just inside the lip 28, thus provides a seat for the backing 12, which facilitates automated manufacturing of the package 10 by providing accurate relative positioning of the backing 12 and cover 14. The lip 28 also advantageously blocks access to the edges of the backing 12. Since a thief cannot grasp the edges of the backing 12, he or she cannot attempt to easily peel the backing 12 from the cover 14 in order to remove the product 16.

In one preferred embodiment, the backing 12 is preferably permanently adhered to the cover 14 using RF welding, ultrasonic welding, UV welding or other similar methods. Less permanent methods, such as heat sealing, may also be used. The adhesion preferably only occurs in discrete areas of the package 10, and preferably in areas where the adhesion makes it very difficult to separate the backing 12 from the cover 14. One such area is the junction of the rim 32 and the perimeter of the backing 12. If the edges of the backing 12 are tightly sealed against the cover 14, the backing 12 is extremely difficult to peel away from the cover 14, because a thief cannot effectively grasp the edges of both pieces in order to pull them apart. Other preferred areas for adhesion are around the inside edge of the ridge 26, and around the edges of any bulges 22.

RF welding, ultrasonic welding and UV welding, which fuse the two bonded surfaces together, produce such a strong bond between the backing 12 and cover 14, that it is virtually impossible for a thief to separate the two. Thus, the lip 28 feature of the cover 14 is not essential to prevent tampering when a permanent sealing method is used. The backing and cover may instead be adhered to one another with a tear seal. Even if a thief could separate the backing 12 from the cover 14 by peeling, the process would require a substantial amount of effort, and would produce an exceptional amount of noise. This would surely attract the attention of other store patrons or store personnel, thereby decreasing the thief s chances of successfully exiting the store with the product 16.

Further, the resistance of the strong plastic backing 12 and cover 14 to being cut or torn also prevents a thief from opening the package 10 inside the store without someone noticing. Prior art packages having a cardboard backing 12 are easy for the thief to quickly tear open in order to remove the product 16. To tear the rigid plastic of the present package 10, however, would require a Herculean effort and generate a great deal of noise.

In order to provide stronger adhesion, glue or another adhesive may be applied to the front surface 20 of the backing 12 or the back surface 30 of the cover 14 before the sealing process takes place. The adhesive may be applied only in areas where adhesion is to take place, or the adhesive may be applied to the entire front surface 20 of the backing 12, for example. If the glue is applied to the entire surface 20 of the backing 12, the glue is preferably of the type that will not adhere to the product 16. The glue may, for example, be applied to the backing 12 and then allowed to dry before the package 10 is assembled. The glue in the adhesion areas is then activated by heat, RF waves, ultrasonic waves or another sealing method. Preferably, any adhesive used is transparent so as not to interfere with consumers reading the printing 18 on the backing 12.

As discussed above, the current package 10 is advantageously cheap to assemble. Not only is the step of placing a cardboard insert within the package eliminated, but the assembly process is also easily automated. With earlier clamshell designs, a human laborer would have to perform the steps of placing the product and cardboard insert within the package, and then closing the package by hand. With the current package, a laborer must still place the product within the cover, but the remaining steps of placing the backing on the cover and sealing the two together are easily performed by machine.

The package 10 is also resistant to tampering. The tough thermoplastic materials used to construct the package 10 are resistant to puncture and tearing, and are more difficult to cut than materials used in prior art package designs. The design of the package 10 also makes it resistant to bending. The combination of effective theft deterrence and low cost enables the package 10 to provide the protection of a clamshell at the price of a blister pack.

SCOPE OF THE INVENTION

The above presents a description of the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A product package to deter theft and prevent unauthorized access to the product, the package comprising:

a flat, thin, opaque thermoplastic sheet forming a backing, the backing having printing with at least two colors thereon; and a thermoplastic cover having at least one cavity formed therein, the cavity creating a product-enclosing space in combination with the backing, the area of product-enclosing space on the backing being substantially smaller than the area of the cover, such that the package is not easily concealed on one's person, the cover having a raised ridge at least partially surrounding and spaced outwardly from the product enclosing space, the cover also having a lip that surrounds edges of the backing and restricts access to the edges of the backing; wherein a peripheral portion of the backing is permanently secured to a peripheral portion of the cover through an RF weld, an ultrasonic weld, a UV weld, a heat seal, or an adhesive, the thermoplastic forming the backing and the cover being strong, tough and highly resistant to manual tearing or puncturing, such that the product-enclosing space is substantially inaccessible unless the backing and/or the cover is cut with a cutting instrument or otherwise destroyed by non-manual means.

2. The package of claim 1 wherein the backing and the cover are constructed of polyvinylchloride.

3. The package of claim 1 wherein the backing includes printing on two opposite surfaces.

4. A method of packaging a product to deter theft and prevent unauthorized access to the product, the method comprising the steps of:

printing in at least two colors on first and second surfaces of a first sheet of plastic, the first sheet of plastic forming a backing for a product package;

creating a recess in a second sheet of plastic, the second sheet of plastic forming a cover for the package;

placing a product in the recess; and permanently securing peripheral portions of the backing and the cover together, thereby securing the product therebetween, the backing and the cover being made of strong tough plastic that is highly resistant to manual tearing or puncturing so as to prevent a would-be thief from gaining access to the product.

5. The method of claim 4, wherein the securing step comprises RF welding, ultrasonic welding, UV welding, heat sealing or the use of an adhesive.

6. The method of claim 4, further comprising the step of forming in the cover a ridge substantially encircling a portion of the cover.

7. The method of claim 4, further comprising the step of forming in the cover a lip substantially encircling the peripheral portions of the cover and the backing and restricting access to edges of the backing.

8. The method of claim 4, wherein the package does not include means to facilitate access to the recess.

* * * * *